US006224347B1

(12) United States Patent
Clark et al.

(10) Patent No.: US 6,224,347 B1
(45) Date of Patent: May 1, 2001

(54) LOW VOLUME, HIGH PRECISION, POSITIVE DISPLACEMENT PUMP

(75) Inventors: George A. Clark; Robert J. Hayes, both of Lewis Center, OH (US)

(73) Assignee: The Gorman-Rupp Company, Mansfield, OH (US)

( * ) Notice: Subject to any disclaimer, the term of this patent is extended or adjusted under 35 U.S.C. 154(b) by 0 days.

(21) Appl. No.: 09/394,252

(22) Filed: Sep. 13, 1999

(51) Int. Cl.[7] ..... F04B 1/26
(52) U.S. Cl. ..... 417/222.1; 417/460; 417/557
(58) Field of Search ..... 417/460, 461, 417/465, 470, 471, 481, 482, 485, 489, 557, 214, 218, 219, 220, 222.1

(56) References Cited

U.S. PATENT DOCUMENTS

| | | | | |
|---|---|---|---|---|
| 3,168,872 | | 2/1965 | Pinkerton | 103/157 |
| 3,257,953 | | 6/1966 | Pinkerton | 103/38 |
| 3,578,879 | * | 5/1971 | Long | 417/62 |
| 4,008,003 | | 2/1977 | Pinkerton | 417/250 |
| 4,479,759 | | 10/1984 | Zeitz | 417/500 |
| 4,560,323 | * | 12/1985 | Orchard | 417/27 |
| 4,575,317 | | 3/1986 | Lindner | 417/500 |
| 4,941,809 | | 7/1990 | Pinkerton | 417/500 |
| 4,971,532 | * | 11/1990 | Slattery | 417/435 |
| 5,015,157 | | 5/1991 | Pinkerton et al. | 417/53 |
| 5,044,889 | | 9/1991 | Pinkerton | 471/53 |
| 5,092,037 | | 3/1992 | Pinkerton | 29/888.02 |
| 5,120,199 | | 6/1992 | Youngs et al. | 417/18 |
| 5,246,354 | | 9/1993 | Pardinas | 417/500 |
| 5,253,983 | * | 10/1993 | Suzuki et al. | 417/485 |
| 5,279,210 | | 1/1994 | Pinkerton | 92/170.1 |
| 5,299,446 | | 4/1994 | Pardinas et al. | 73/3 |
| 5,312,233 | | 5/1994 | Tanny et al. | 417/316 |
| 5,320,499 | * | 6/1994 | Hamey et al. | 417/218 |
| 5,494,420 | | 2/1996 | Mawhirt et al. | 417/500 |
| 5,564,905 | * | 10/1996 | Manring | 417/222.1 |
| 5,863,187 | * | 1/1999 | Bensley et al. | 417/218 |

* cited by examiner

*Primary Examiner*—Teresa Walberg
*Assistant Examiner*—Thor Campbell
(74) *Attorney, Agent, or Firm*—Renner, Kenner, Greive, Bobak, Taylor & Weber

(57) ABSTRACT

A pump (10) includes a motor (11) which rotates a pumping assembly (52) which includes a face plate (54) and a cylinder (56). A piston (67) reciprocates in the cylinder (56) to draw fluid into the cylinder (56) from an intake groove (78) and an intake port (76) formed in a manifold plate (73) positioned adjacent to the face plate (54), and to thereafter discharge that fluid to a discharge groove (80) and a discharge port (77) formed in the manifold plate (73). The piston (67) rides on a swash plate (49) as the face plate (54) rotates, and the extent of reciprocation of the piston (67) and therefore the amount of fluid to be dispersed on each reciprocation of the piston (67) is controlled by an adjuster wheel (40) which can be moved to allow the swash plate (49) to pivot a predetermined extent. As such, the pump (10) can dispense a known precise amount of fluid on each reciprocation of the piston (67).

35 Claims, 5 Drawing Sheets

LOW VOLUME, HIGH PRECISION, POSITIVE DISPLACEMENT PUMP

TECHNICAL FIELD

This invention relates to a positive displacement pump particularly suited for delivering low volumes of a fluid with high precision. More specifically, this invention relates to such a pump whereby the precise amount of fluid to be delivered may be adjusted, and the accurate delivery of fluid is assured by the elimination of dead space in the pump.

BACKGROUND ART

Pumps are often utilized to meter or otherwise deliver small quantities of fluid with a required high precision. Such accurate and repeatable dispensing of a fluid is often required in laboratory instrumentation environments such as the photographic processing industry or in the medical field such as in the metering and delivery of a low volume, precise amount of reagent to test blood.

Many pumps used for this purpose are of the positive displacement type which normally include poppet valves or check valves at the inlets and outlets thereof. However, such valves are usually, most conveniently, made of rubber material which can be the subject of attack by many chemicals. As a result, such valves will deteriorate causing the pump to lose its accuracy and eventually resulting in the need for replacement.

Thus, valveless, positive displacement, piston pumps are more suited for this application. However, known of such pumps may not consistently provide the accuracy required for many applications. For example, the positive displacement piston pump shown in U.S. Pat. No. 3,168,872 is typical of those that are available today. The problem with these types of pumps is that there is some dead space in the piston chamber where a small amount of fluid can remain after each piston stroke. Since most all fluids contain entrapped gas, such may also tend to accumulate in that dead space and form a small gas bubble. Eventually, the piston which is intended to deliver fluid will be compressing gas and not dispensing the correct amount of fluid. In effect then, the stroke of the piston is compressing and uncompressing the gas bubble to the detriment of accurate volume fluid dispensing.

The need exists, therefore, for a pump which will repeatedly deliver a precise amount of fluid, even in small microliter volumes.

DISCLOSURE OF THE INVENTION

It is thus an object of the present invention to provide a pump which can deliver low volumes of fluid with high precision.

It is another object of the present invention to provide a pump, as above, which is valveless and utilizes a piston moveable in a chamber to deliver the fluid.

It is an additional object of the present invention to provide a pump, as above, in which essentially all dead space in the pump is eliminated.

It is yet another object of the present invention to provide a pump, as above, in which the stroke of the piston is easily adjustable to provide a wide range of control over the precise, minute amount of fluid to be dispensed.

These and other objects of the present invention, as well as the advantages thereof over existing prior art pumps, which will become apparent from the description to follow, are accomplished by the improvements hereinafter described and claimed.

In general, a fluid pump made in accordance with the present invention includes a rotating cylinder having a piston capable of reciprocating therein. A plate is positioned adjacent to the cylinder, the plate having a fluid intake port communicating with an intake groove formed in the plate, and a fluid discharge port communicating with a discharge groove formed in the plate. The grooves and the ports communicate with the cylinder such that upon rotation of the cylinder and reciprocation of the piston, the piston sequentially draws fluid from the intake groove and the intake port into the cylinder and then discharges that fluid from the cylinder into the discharge groove and through the discharge port.

In accordance with another aspect of the present invention, a fluid pump includes a motor and a pumping assembly rotated by the motor. The pumping assembly includes a face plate having a port therein, a cylinder associated with the plate and communicating with the port, and a piston capable of reciprocating in the cylinder. A manifold plate is positioned adjacent to the face plate and includes a fluid intake port, an intake groove communicating with the intake port, a fluid discharge port, and a discharge groove communicating with the discharge port. Upon rotation of the pumping assembly and reciprocation of the piston, the piston sequentially draws fluid from the intake groove and the intake port through the port of the face plate and into the cylinder and then discharges that fluid through the port of the face plate and into the discharge groove and through the discharge port.

In accordance with yet another aspect of the present invention, a fluid pump includes a stationary plate having a fluid intake area and a fluid discharge area. A second plate is positioned adjacent to the stationary plate, and means are provided to rotate the second plate. A cylinder is associated with the second plate and selectively communicates with the fluid intake area and the fluid discharge area. A piston is positioned in the cylinder, and means are provided to reciprocate the piston in the cylinder to selectively draw fluid from the intake area into the cylinder and discharge that fluid from the cylinder into the discharge area.

A preferred exemplary pump incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
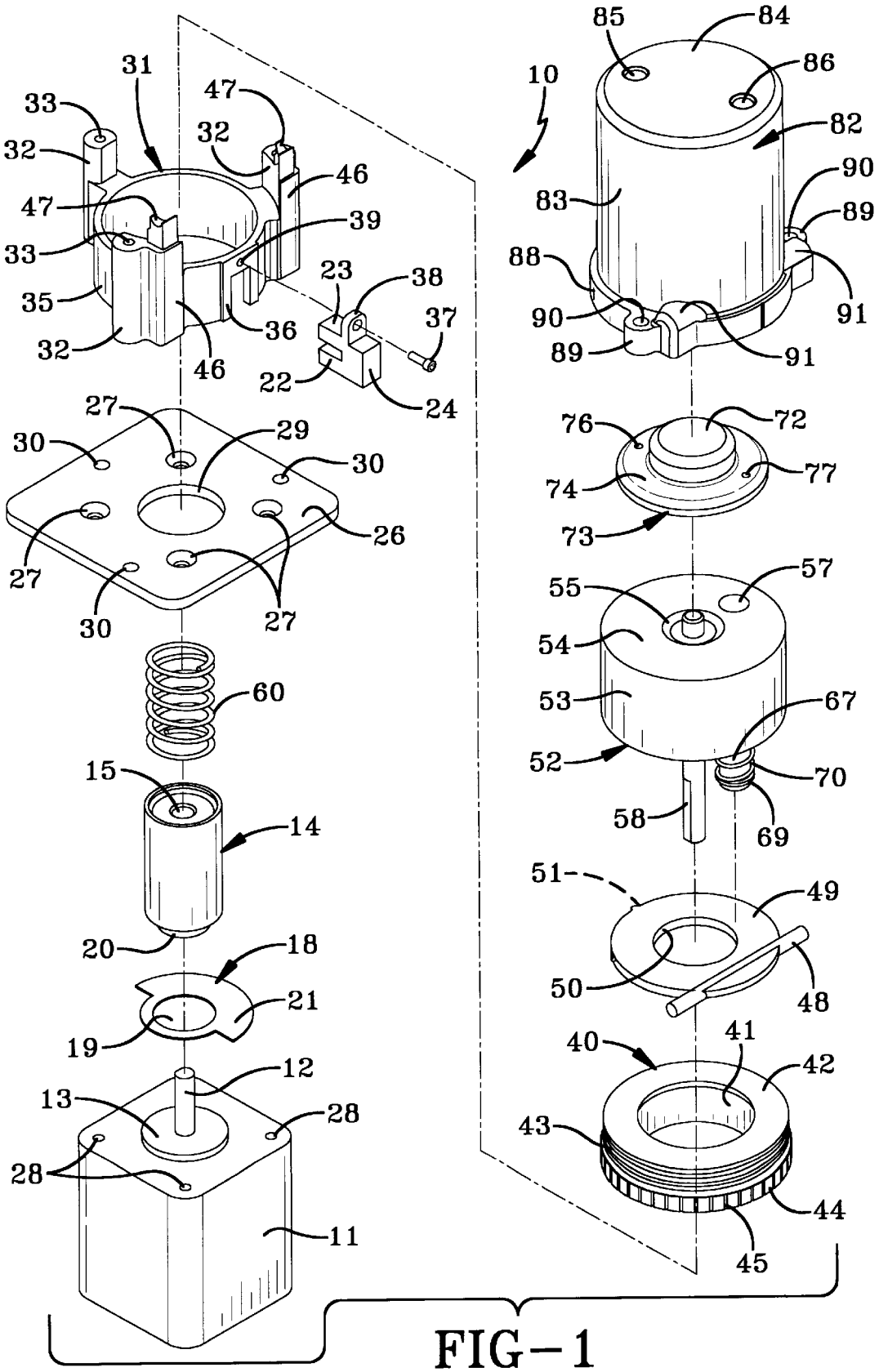
FIG. 1 is a somewhat schematic, exploded perspective view of most of the components of a pump made in accordance with the present invention.

A pump made in accordance with the concepts of the present invention is indicated generally by the numeral 10 and, as will become apparent, pump 10 is of the type known as a valveless positive displacement pump. Pump 10 is powered by a motor 11 which can be a conventional stepper motor whereby the degree of angular rotation of the stud shaft 12 of motor 11 can be controlled. Shaft 12 can be round but could also be somewhat D-shaped for purposes of driving engagement with other components of pump 10 as will hereinafter be described. As shown, motor 11 preferably includes a raised boss 13 surrounding shaft 12 which serves as a locator for other pump components.

A shaft coupler is generally indicated by the numeral 14 and may be made of a plastic material or may be machined of a suitable metallic material, such as aluminum. Shaft coupler 14 includes an internal axial opening 15 extended therethrough, the lower end of which is received over motor shaft 12 so that coupler 14 is rotated by motor 11. In this regard, opening 15 may be D-shaped or round and a set screw 16 may be provided to assure attachment of shaft 12 to coupler 14. Coupler 14 may be formed integral with a counter wheel, generally indicated by the numeral 18, or alternatively, coupler 14 and wheel 18 may be separately formed and thereafter assembled.

Counter wheel 18 has a central aperture 19 therein, to be received around and carried by a lug 20 formed at the bottom of coupler 14. Counter wheel 18 also includes a semicircular wing 21 which, as will hereinafter be described in more detail, is received between the jaws 22 and 23 of a conventional magnetic counter 24. As such, counter 24 senses each revolution of motor shaft 12 by either the presence or the absence of wing 21 between jaws 22 and 23 to control the number of revolutions of shaft 12 before motor 11 is turned off.

A mounting plate 26 is attached to the top of motor 11 by fasteners (not shown) which extend through apertures 27 in plate 26 and into holes 28 formed at the top of motor 11. Plate 26 has a central aperture 29 formed therethrough to be received over boss 13. Plate 26 overhangs motor 11 and at preferably three locations outboard of motor 11, plate 26 is provided with apertures 30.

A lower pump casing, generally indicated by the numeral 31, and preferably injection molded of any suitable plastic material, is carried by plate 26. To that end, casing 31 is provided with three circumferentially spaced bosses 32 having apertures 33 therethrough which are aligned with plate apertures 30 so that suitable fasteners 34 (one shown in FIG. 3) can pass therethrough to mount casing 31 onto plate 26. Casing 31 has a generally cylindrical sidewall 35 with the bosses 32 being positioned on the outside thereof and extending upwardly therefrom. Sidewall 35 is provided with a notch 36 through which the jaws 22 and 23 of counter 24 may pass. Counter 24 may be attached to casing 31, as by a fastener 37, received through an aperture tab 38 and into a hole 39 formed in sidewall 35.

An adjuster wheel, generally indicated by the numeral 40, is positioned above casing sidewall 35 and within bosses 32. Wheel 40 has a central aperture 41 and a flat upper circular surface 42. A portion of the periphery of wheel 40 is provided with threads 43 and the remainder of the periphery of wheel 40 constitutes an adjustment knob 44 having a plurality of circumferentially spaced ribs 45 thereon. As will hereinafter be described in detail, turning wheel 40 by grasping knob 44 adjusts the fluid output for one revolution of motor shaft 12. Ribs 45 not only provide wheel 40 with a facile gripping area, but also, if desired, they can be spaced proportional to the amount of fluid to be dispensed and an indicator, such as an arrow (not shown) on casing sidewall 35 could point to a particular rib 45. As such, the user would know that rotating wheel 40 a distance of one rib 45 would, for example, increase the output of pump 10 by, for example, one microliter per revolution of the motor shaft 12.

Lower pump casing 31 is also provided with two circumferentially spaced towers 46 shown to be adjacent to two of the bosses 32. A cradle 47 is formed at the top of each tower 46 to receive a pin 48 carried on a chord of a circular swash plate 49 having a central aperture 50. The underside of plate 49 is provided with a downwardly directed protuberance 51 (FIG. 3) which, as will hereinafter be described in detail, rests on upper surface 42 of adjuster wheel 40. Protuberance 51 is preferably positioned diametrically opposite to the center of pin 48.

A pumping assembly is generally indicated by the numeral 52 and includes a plurality of components all preferably made of a ceramic material. Pumping assembly 52 could be formed as one piece or could be formed of several components assembled together. Pumping assembly 52 includes a cylindrical body 53 which forms an upper face plate 54. Body 53 has a preferably D-shaped central bore 55 and a cylinder bore 56 extending therethrough. Bore 56, as will hereinafter be described, thereby forms a cylinder intake/discharge port 57 in face plate 54.

A pump shaft 58, preferably of a D-shape, has its upper end engaging bore 55, and its lower end may be received in axial opening 15 of coupler 14. If desired, shaft 58 may also be attached to coupler 14 by a set screw 59. As such, upon activation of motor 11, shaft 58 rotates pumping assembly body 53. However, shaft 58 is axially slidably received in body 53, with a face seal tension spring 60 being received around shaft 58 and positioned between coupler 14 and pumping assembly body 53 to urge pumping assembly 52 away from motor 11.

Pumping assembly 52 also includes a piston 67 which is axially moveable to reciprocate within cylinder bore 56. Piston 67 has a circumferential slot 68 formed near the bottom thereof to receive a retainer ring 69. Ring 69 forms a shoulder to receive a spring 70 which is thus positioned between ring 69 and the bottom of pumping assembly body 53 to urge piston 67 downward, that is, toward motor 11. The bottom of piston 67 includes a spherical surface 71 which as will hereinafter be described in more detail, rides on top of swash plate 49 and provides a smooth rubbing surface.

A ceramic manifold plate is generally indicated by the numeral 73 and includes an upper face 74 and a lower seal face 75 (FIGS. 5 and 6) which are circular to correspond with face plate 54 of pumping assembly 52. A fluid intake port 76 and a fluid discharge port 77 extend through manifold plate 73. An intake manifold in the form of a crescent-shaped groove 78 is formed in seal face 75. Groove 78 starts at end 79 and preferably becomes progressively deeper until it reaches and communicates with intake port 76. A discharge manifold in the form of a crescent-shaped groove 80 is formed in seal face 75 and generally opposes groove 78. Like groove 78, groove 80 starts at end 81 and preferably becomes progressively deeper until it reaches and communicates with discharge port 77.

Figure 2:
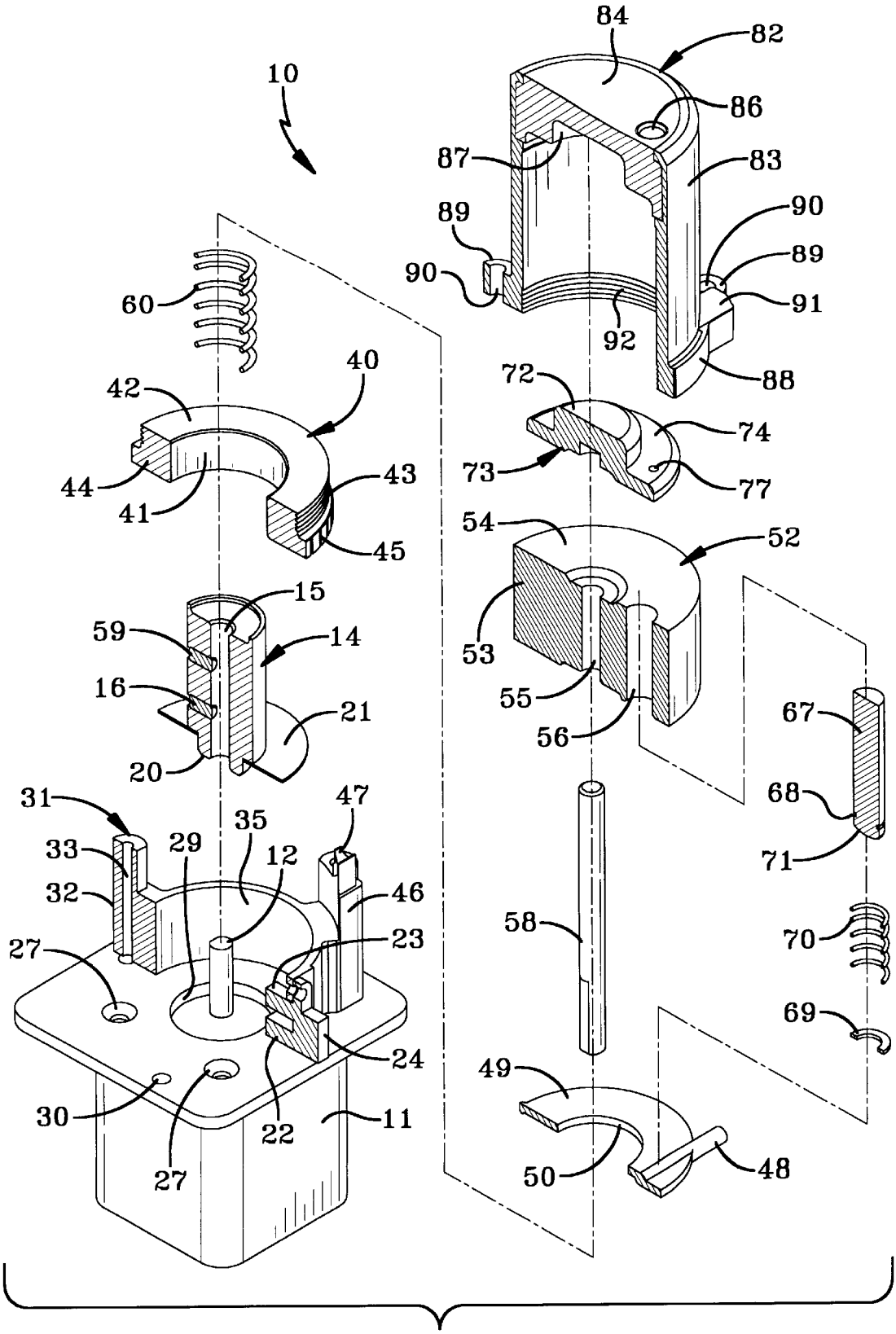
FIG. 2 is a view similar to FIG. 1 but showing most of the components of the pump in section.

An upper pump casing is generally indicated by the numeral 82 and is preferably made of an injection-molded plastic material. Upper casing 82 includes a cylindrical sidewall 83 which is closed at one end by an upper wall 84. Wall 84 includes a fluid inlet port 85, alignable with port 76, and a fluid discharge port 86 alignable with port 77. As best shown in FIG. 2, the underside of wall 84 is provided with a circular slot 87 to receive socket 72 of manifold plate 73 so that the inlet ports 76 and 85 and the discharge ports 77 and 86 may be respectively aligned. Manifold plate 73 may be attached to upper casing 82 by any suitable means, as would be known in the art, or alternatively, manifold plate 73 may be integrally formed with upper casing 82 to be a permanent part thereof. Ports 85 and 86 are adapted to be connected to conventional fluid lines (not shown) with inlet port 85 thereby communicating with a source of fluid to be pumped, and discharge port 86 thereby communicating with the location to which the fluid is to be dispensed.

Figure 3:
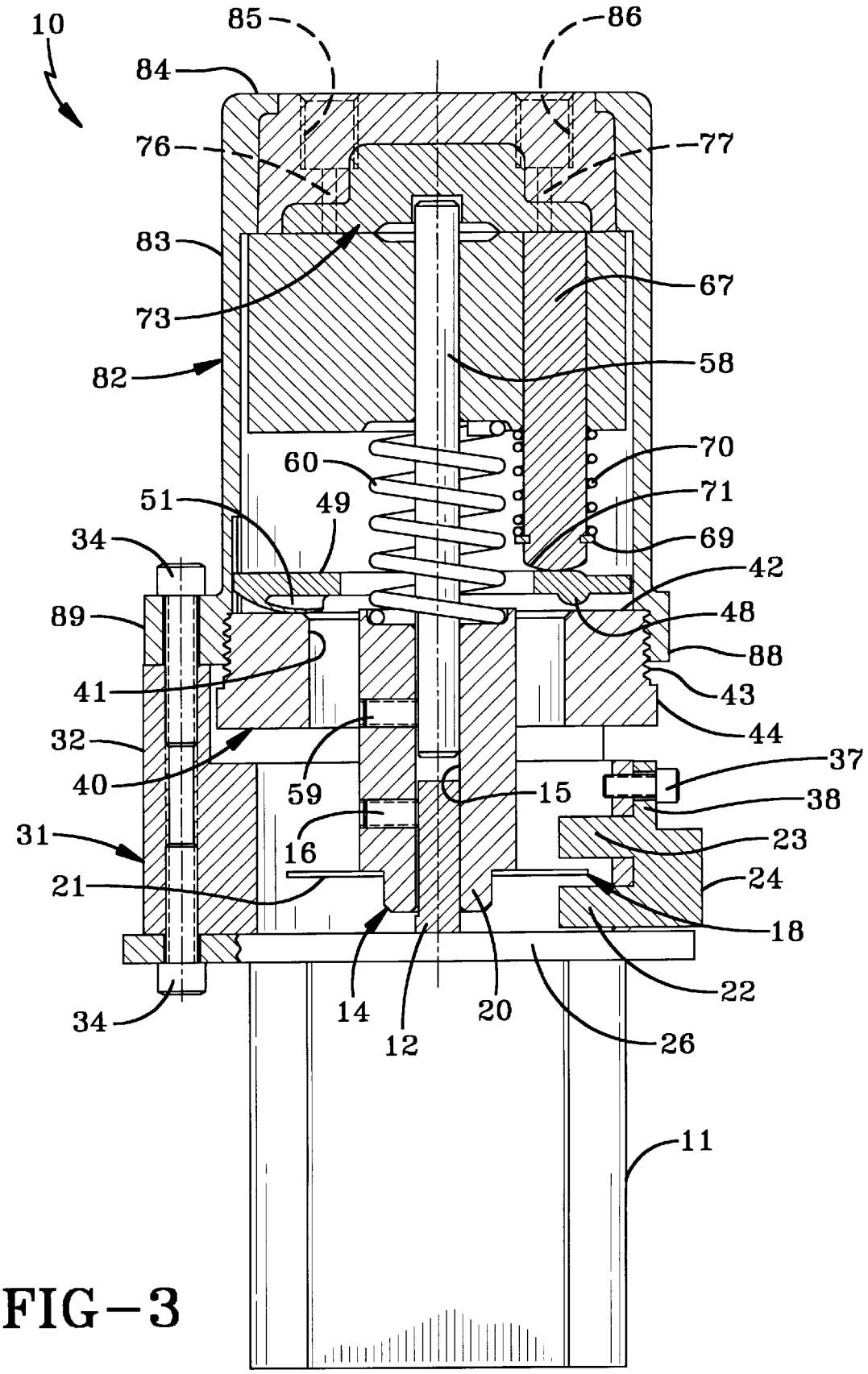
FIG. 3 is a vertical cross-section of an assembled pump made in accordance with the present invention.
Figure 4:
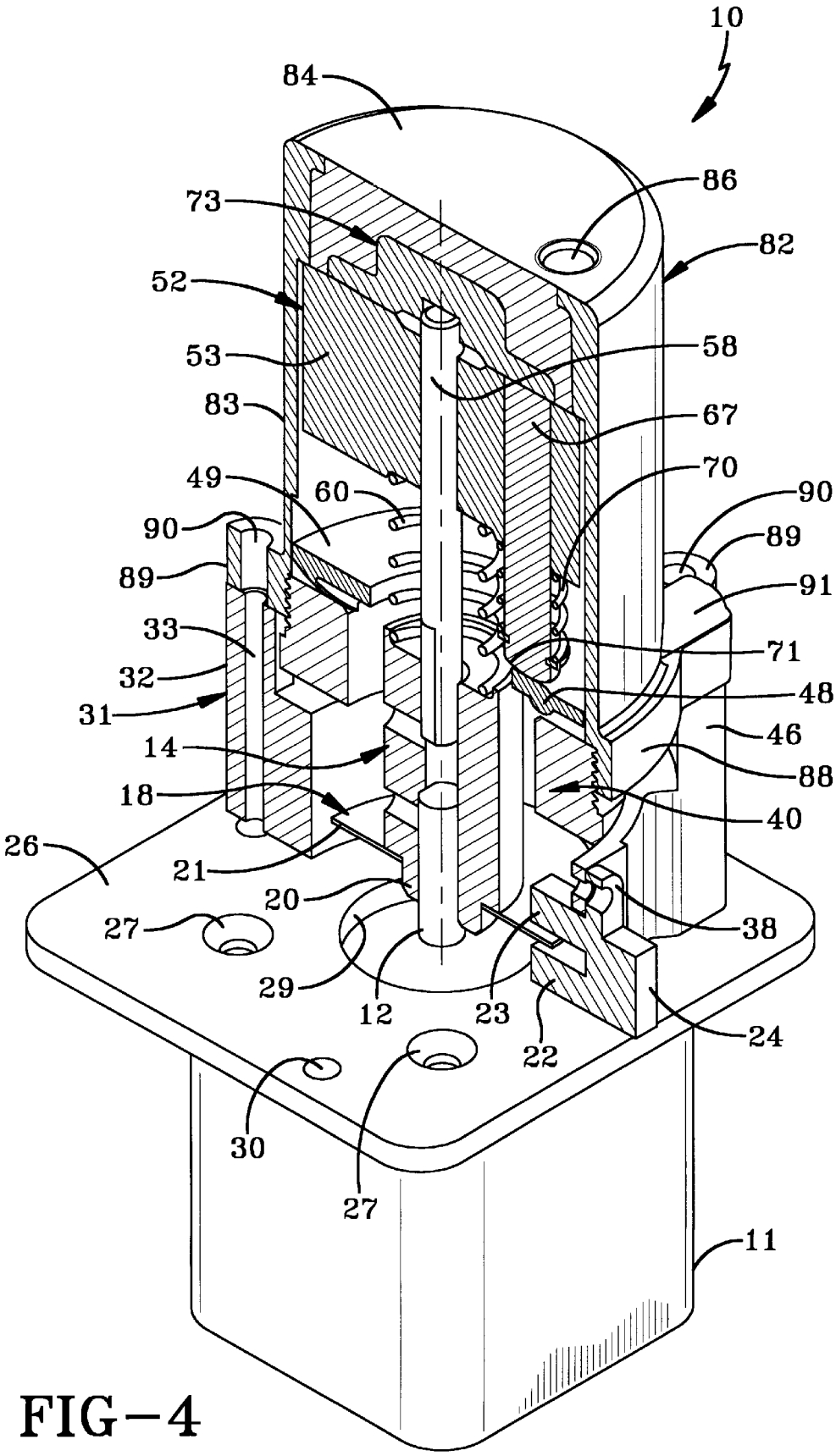
FIG. 4 is a partially sectioned, perspective view of a pump made in accordance with the present invention.

A lower flange 88 extends outwardly from near the bottom of sidewall 83, and flange 88 carries three circumferentially spaced lugs 89 having apertures 90 therethrough to be aligned with apertures 33 in bosses 32 of lower casing 31. As a result, and as shown in FIG. 3, an additional fastener 34 can attach casing 82 to plate 26 with casing 31 sandwiched therebetween. Of course, fasteners 34 could be replaced with one fastener to attach casing 82, plate 26 and casing 31 together. A portion of flange 88 is also formed with chordal hub covers 91 which, together with cradles 47 of towers 46 of casing 31, encase pin 48 of swash plate 49. As shown in FIG. 2, the lower internal portion of sidewall 83, generally opposite to flange 88, is provided with threads 92 which are adapted to matingly engage threads 43 of adjuster wheel 40. If desired, a set screw (not shown) may be provided through flange 88 to hold adjuster wheel 40 at its desired position, which would be particularly useful if a pump 10 were provided which would be intended to be most often utilized at one setting.

Based on the foregoing, the proper assembly of pump 10 should be readily apparent. Briefly summarizing such assembly, mounting plate 26 is attached to motor 11 and lower casing 31 is positioned thereon. Adjuster wheel 40 is positioned on lower casing 31 and pin 48 of swash plate 49 is positioned on cradles 47. Shaft coupler 14 is attached to motor shaft 12 and carries counter wheel 18 as previously described. As such, shaft coupler 14 extends up through the center of lower casing 31, adjuster wheel 40, and swash plate 49, and via shaft 58 carries pumping assembly 52 as previously described. Manifold plate 73 is placed on face plate 54 of pumping assembly 52 and the upper motor casing 82 is attached to plate 26 as previously described. Such establishes the relative axial location of all of the components of pump 10 as shown in FIG. 3. As previously described, because pumping assembly 52 can move axially relative to shaft coupler 14, face seal spring 60 maintains face plate 54 snugly against manifold seal face 75. It should be noted that while the drawings show motor 11 at the bottom of pump 10 and casing 82 at the top thereof, and while the words "upper," "lower," "above," "below," and the like have been used herein to describe the location of various components of pump 10, such orientation is not critical. Pump 10 could well operate with motor 11 on top and casing 82 at the bottom and, in fact, will often be located horizontally on its side in certain pumping applications.

The operation of pump 10 will now be described in detail. In general, activation of motor 11 turns pumping assembly 52 relative to the stationary manifold plate 73. As pumping assembly 52 rotates, piston 67 rides on swash plate 49, the angle of which is adjusted by adjuster wheel 40 to control the axial movement of piston 67 in its cylinder 56. As piston 67 orbits beneath face 75 of plate 73, a predetermined amount of fluid is drawn in to cylinder 56 as piston 67 passes under intake groove 78. The stroke of piston 67 then reverses and fluid is discharged from pump 10 as piston 67 passes under discharge groove 80. The pumping assembly 52 will rotate the number of revolutions necessary to dispense a predetermined total quantity of fluid, at which time counter 24 will deactivate motor 11.

Figure 5:
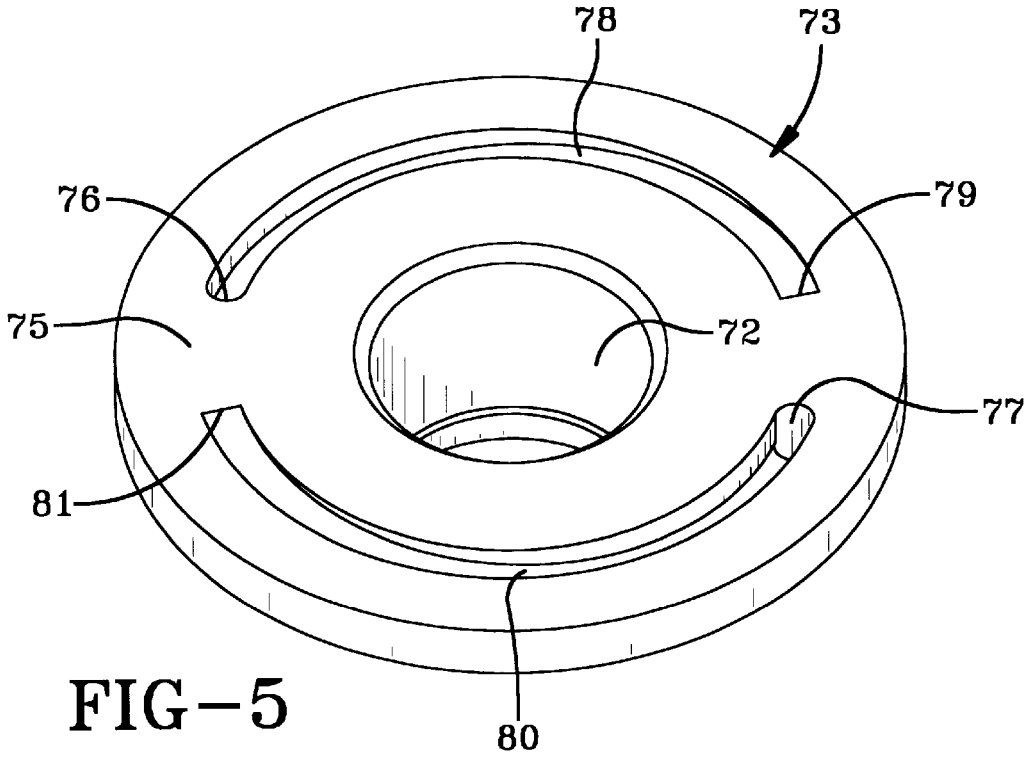
FIG. 5 is a perspective view of the face seal side of a manifold component of the pump of the present invention.
Figure 6:
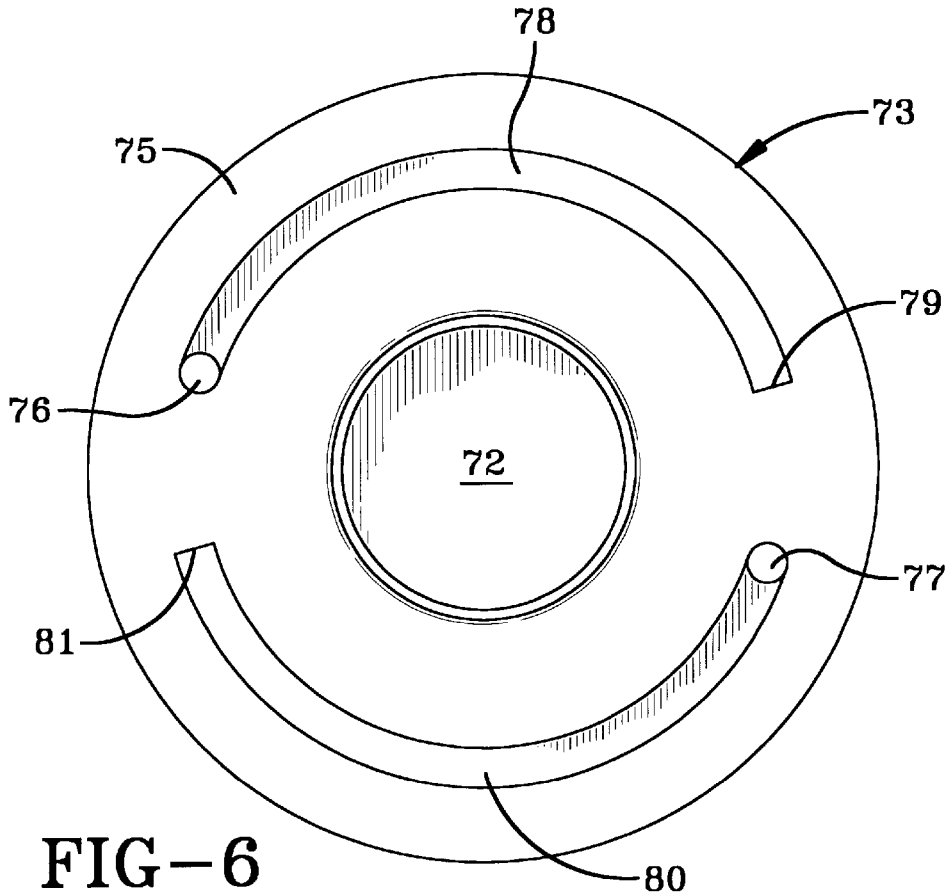
FIG. 6 is an elevational view of the face seal plate shown in FIG. 5.

More specifically as to the operation of pump 10, and with primary reference to FIGS. 3, 5 and 6, FIG. 3 shows pumping assembly 52 in an at-rest position. It should be noted that in this position, piston 67 is at the upper open end of cylinder 56 and adjacent to face 75 of plate 73. Such assures that the precise amount of fluid has been discharged from cylinder 56. Also in this position, piston 67 is located between discharge port 77 and end 79 of intake groove 78 of plate 75.

FIG. 3 shows pump 10 in a neutral or non-pumping position; that is, because swash plate 49 is horizontal, if motor 11 were activated, there would be no displacement of piston 67. From this position, to establish the amount of fluid to be dispensed in one revolution of pumping assembly 52, adjuster wheel 40 is turned to effectively begin unscrewing wheel 40 from casing 82 via their respective threads 43 and 92 until a predetermined position, known to represent an amount of fluid to be dispensed on each shaft revolution, is reached. For example, such could be five microliters of fluid. By thus turning wheel 40, it moves downwardly and swash plate 49 is allowed to pivot on pin 48. As such, as viewed in FIG. 3, the left side of plate 49 would be lower than the right side of plate 49. Counter 24 is then set, in a manner known in the art, to permit motor 11 to run through a predetermined number of revolutions dependent on the total quantity of fluid to be dispensed during one dispensing cycle. In the example above, if the total amount of fluid to be dispensed during a cycle were to be fifty microliters, then counter 24 would stop motor 11 after ten revolutions of counter wheel 18.

With adjuster wheel 40 so positioned to allow swash plate 49 to assume an angular position, upon activation of motor 11, piston 67 will orbit in a counterclockwise manner, as viewed in FIG. 6, and as its bottom surface 71 rides on swash plate 49, piston 67 will now move downwardly as the port 57, representing the upper open end of cylinder 56, now moves into communication with intake groove 78. Such action draws fluid from groove 78 and into cylinder 56 until piston 67 has moved to its desired extent, as dictated by the adjustment just described. At this point, piston 67 will be at the left in FIG. 3, over the lowest position of swash plate 49, that is, above protuberance 51, and as viewed in FIG. 6, will be between intake port 76 and the end 81 of groove 80. During continued orbiting of piston 67, its bottom surface 71 will ride up swash plate 49 causing piston 67 to discharge the load of fluid in cylinder 56 into discharge groove 80 and out through discharge port 77, and ultimately pump discharge port 86. At this point, piston 67 has returned to its original position between discharge port 77 and end 79 or intake groove 78. Because piston 67 will also have returned to the FIG. 3 position, that is, all the way to the port 57 end of cylinder 56, it is assured that the precise amount of fluid has been discharged from pump 10 for each revolution of pumping assembly 52.

It should also be noted that when piston 67 is moving over intake groove 78, it will be drawing fluid therefrom and possibly additional fluid through intake port 76 which communicates with the fluid supply via inlet port 85 of pump 10. Conversely, if the amount of fluid to be drawn into cylinder 56 on each revolution is less than the quantity positioned in groove 78, and confined therein by plate 54, groove 78 will still remain filled by virtue of the fact that replenishing fluid will be drawn in through intake port 76. Likewise, more or less than the quantity of fluid that is always in discharge groove 80 may be forced through discharge port 77 dependent on the comparative quantity of fluid in cylinder 56. Importantly, however, as discussed above, because piston 67 effectively bottoms out on every stroke, essentially all fluid, and its possible entrapped gas, contained in cylinder 56 is discharged on every piston stroke, there being no dead space to potentially collect residues of fluid and/or gas.

It should also be appreciated that the pumping capacity per revolution of pumping assembly 52 could be increased by providing more than one cylinder 56 and piston 67 combination associated with face plate 54. Thus, by circumferentially spacing a plurality of cylinders 64 having a like plurality of ports 57 in face plate 54, the pistons 67 in each of the cylinders 56 would sequentially draw in and discharge a quantity of fluid upon each revolution of face plate 54. As such, the per revolution capacity of pump 10 may be increased.

Moreover, while swash plate 49 has been described herein as the preferred means to reciprocate piston 67 in cylinder 56, an independently controlled actuator, such as a solenoid, could be utilized for that purpose. In such a situation, intake groove 78 and discharge groove 80 could be eliminated and the solenoid activated when cylinder 56 was in communication with intake port 76 and/or discharge port 77 to properly reciprocate piston 67. Such a system would additionally allow pump 10 to have multiple intake and/or discharge ports and pump 10 could then act as a distribution system. That is, fluid from one source could, for example, be directed to multiple locations via a plurality of discharge ports.

In view of the foregoing, it should be evident that a pump constructed and operated as described herein accomplishes the objects of the present invention and otherwise substantially improves the art.

What is claimed is:

1. A fluid pump comprising a rotating cylinder, a flat face plate associated with said cylinder, a piston capable of reciprocating in said cylinder, a flat seal plate positioned adjacent to said face plate, a fluid intake port in said seal plate, an intake groove in said seal plate communicating with said intake port, a fluid discharge port in said seal plate, a discharge groove in said seal plate communicating with said discharge port, and means to maintain said face plate against said seal plate to provide the only seal around said grooves and said ports, said grooves and said ports communicating with said cylinder such that upon rotation of said cylinder relative to said seal plate and upon reciprocation of said piston, said piston sequentially draws fluid from said intake groove and said intake port into said cylinder and then discharges that fluid from said cylinder into said discharge groove and through said discharge port.

2. A fluid pump according to claim 1 further comprising a motor shaft, a motor rotating said motor shaft, and means to couple said motor shaft to said face plate to rotate said face plate.

3. A fluid pump according to claim 2 wherein said means to couple includes a pump shaft and a shaft coupler carried by said motor shaft, said pump shaft being connected to said shaft coupler so that said pump shaft is rotatable with said shaft coupler yet said pump shaft is axially moveable with respect to said face plate.

4. A fluid pump according to claim 3 wherein said means to maintain is a spring positioned around said pump shaft between said face plate said shaft coupler.

5. A fluid pump according to claim 1 further comprising a swash plate, said piston riding on said swash plate.

6. A fluid pump according to claim 5 further comprising a ring carried by said piston and a spring between said ring and said face plate, said spring maintaining said piston against said swash plate.

7. A fluid pump according to claim 5 further comprising a casing, said casing pivotally carrying said swash plate.

8. A fluid pump according to claim 7, said swash plate including a pin and said casing including opposed cradles to pivotally carry said pin.

9. A fluid pump according to claim 8 further comprising an adjuster wheel, said swash plate having a protuberance capable of resting on said adjuster wheel.

10. A fluid pump according to claim 9 wherein said adjuster wheel and said casing are provided with mating threads, whereby movement of said adjuster wheel on said threads allows said swash plate to pivot on said pin thereby regulating the reciprocating of said piston.

11. A fluid pump according to claim 1 further comprising a motor rotating a shaft to rotate said cylinder, a wheel rotated by said shaft, and a counter positioned adjacent to said wheel, said counter determining the number of rotations of said wheel and deactivating said motor upon a predetermined number of revolutions.

12. A fluid pump comprising a motor; a pumping assembly rotated by said motor; said pumping assembly including a flat face plate having a port therein, a cylinder associated with said face plate and communicating with said port, and a piston capable of reciprocating in said cylinder; and a flat manifold plate maintained against said face plate so as to provide a seal between said plates; said manifold plate having a fluid intake port, an intake groove communicating with said intake port, a fluid discharge port, and a discharge groove communicating with said discharge port; the seal between said plates being such that upon rotating of said pumping assembly and reciprocation of said piston, said piston sequentially draws fluid from said intake groove and said intake port, through said port of said face plate, and into said cylinder and then discharges that fluid from said cylinder through said port of said face plate, into said discharge groove, and through said discharge port without leakage of the fluid between said plates.

13. A fluid pump according to claim 12 further comprising a motor shaft rotated by said motor, and means to couple said motor shaft to said pumping assembly.

14. A fluid pump according to claim 13 wherein said means to couple includes a pump shaft and a shaft coupler carried by said motor shaft, said pump shaft being connected to said shaft coupler so that said pump shaft is rotatable with said shaft coupler yet said pump shaft is axially moveable with respect to said face plate.

15. A fluid pump according to claim 14 further comprising a wheel rotated by said shaft, and a counter positioned adjacent to said wheel, said counter determining the number of rotations of said wheel and deactivating said motor upon a predetermined number of revolutions.

16. A fluid pump according to claim 14 further comprising a spring positioned around said pump shaft coupler and between said face plate and said shaft coupler to maintain the seal between said plates.

17. A fluid pump according to claim 12 further comprising a swash plate, said piston riding on said swash plate.

18. A fluid pump according to claim 17 further comprising a ring carried by said piston and a spring between said ring and said face plate, said spring maintaining said piston against said swash plate.

19. A fluid pump according to claim 17 further comprising a casing, said casing pivotally carrying said swash plate.

20. A fluid pump according to claim 19, said swash plate including a pin and said casing including opposed cradles to pivotally carry said pin.

21. A fluid pump according to claim 20 further comprising an adjuster wheel, said swash plate having a protuberance capable of resting on said adjuster wheel.

22. A fluid pump according to claim 21 wherein said adjuster wheel and said casing are provided with mating threads, whereby movement of said adjuster wheel on said threads allows said swash plate to pivot on said pin thereby regulating the reciprocating of said piston.

23. A fluid pump comprising a stationary plate having a fluid intake area and a fluid discharge area, a second flat plate, means to maintain said second plate against said stationary plate to provide a seal around said fluid intake area and said fluid discharge area, means to rotate said second plate, a cylinder associated with said second plate and selectively communicating with said fluid intake area and said fluid discharge area, a piston in said cylinder, and means to reciprocate said piston in said cylinder to selectively draw fluid from said intake area into said cylinder and discharge that fluid from said cylinder into said discharge area.

24. A fluid pump according to claim 23 wherein said means to rotate includes a motor shaft rotated by a motor, and further comprising means to couple said shaft to said second plate to rotate said second plate.

25. A fluid pump according to claim 24 wherein said means to couple includes a pump shaft and a shaft coupler carried by said motor shaft, said pump shaft being connected to said shaft coupler so that said pump shaft extension is rotatable with said shaft coupler yet said pump shaft extension is axially moveable with respect to said second plate.

26. A fluid pump according to claim 25 further comprising a wheel rotated by said shaft, and a counter positioned adjacent to said wheel, said counter determining the number of rotations of said wheel and deactivating said motor upon a predetermined number of revolutions.

27. A fluid pump according to claim 25 wherein said means to maintain is a spring positioned around said pump shaft between said second plate and said shaft coupler.

28. A fluid pump according to claim 23 further comprising means to adjust the extent of reciprocation of said piston to control the amount of fluid drawn into said cylinder and discharged from said cylinder.

29. A fluid pump according to claim 28 further comprising a casing.

30. A fluid pump according to claim 29 wherein said intake area includes a groove communicating an intake port and said discharge area includes a groove communicating with a discharge port, said casing including a fluid inlet port communicating with said intake port and a fluid discharge port communicating with said discharge port.

31. A fluid pump according to claim 29 wherein said means to reciprocate includes a swash plate pivotally carried by said casing, said piston riding on said swash plate.

32. A fluid pump according to claim 31 wherein said means to reciprocate further includes a ring carried by said piston and a spring between said ring and said second plate, said spring maintaining said piston against said swash plate.

33. A fluid pump according to claim 31, said swash plate including a pin and said casing including opposed cradles to pivotally carry said pin.

34. A fluid pump according to claim 33 wherein said means to adjust includes an adjuster wheel, said swash plate having a protuberance opposed to said pin and capable of resting on said adjuster wheel.

35. A fluid pump according to claim 34 wherein said adjuster wheel and said casing are provided with mating threads, whereby movement of said adjuster wheel on said threads allows said swash plate to pivot on said pin thereby regulating the reciprocating of said piston.

* * * * *